US005864322A

United States Patent [19]

Pollon et al.

[11] Patent Number: 5,864,322

[45] Date of Patent: Jan. 26, 1999

[54] DYNAMIC PLASMA DRIVEN ANTENNA

[75] Inventors: Gerald E. Pollon, Thousand Oaks; Daniel G. Gonzalez, Topanga; Joel F. Walker, Malibu; Lawrence J. Sikora, Simi, all of Calif.

[73] Assignee: Malibu Research Associates, Inc., Calabasas, Calif.

[21] Appl. No.: 788,818

[22] Filed: Jan. 23, 1997

Related U.S. Application Data

[60] Provisional application No. 60/010,468 Jan. 23, 1996.

[51] Int. Cl.[6] ..... H01Q 15/02

[52] U.S. Cl. ..... 343/909; 343/754; 343/778

[58] Field of Search ..... 343/909, 700 MS, 343/754, 910, 853, 776, 777, 778; H01Q 15/02, 15/24

[56] References Cited

U.S. PATENT DOCUMENTS 4,905,014 2/1990 Gonzalez et al. .
5,182,496 1/1993 Manheimer et al. .

*Primary Examiner*—Don Wong
*Assistant Examiner*—Tho Phan
*Attorney, Agent, or Firm*—Hoffmann & Baron, LLP

[57] ABSTRACT

An electronic scan antenna for generating an electrically scanned RF beam in response to an incident RF beam having at least one operating frequency band associated therewith includes a ground plane for reflecting the incident RF beam and a phasing arrangement of plasma structures operatively coupled to the ground plane. Each plasma structure includes gas containing areas which are reflective at the operating frequency range, when ionized, forming ionized plasma areas. Each ionized plasma area is disposed a first distance from the ground plane, a second distance from adjacent ionized plasma areas and each plasma ionized plasma area has a particular size associated therewith. In this manner, each ionized plasma area, in cooperation with the ground plane, provides a portion of a composite RF beam which has a phase shift associated therewith. The electronic scan antenna of the present invention also includes a control circuit for selectively ionizing the gas containing areas such that the size of each ionized plasma area may be dynamically varied so as to dynamically vary the imparted phase shift. In this manner, the composite RF beam may be electronically scanned.

20 Claims, 9 Drawing Sheets

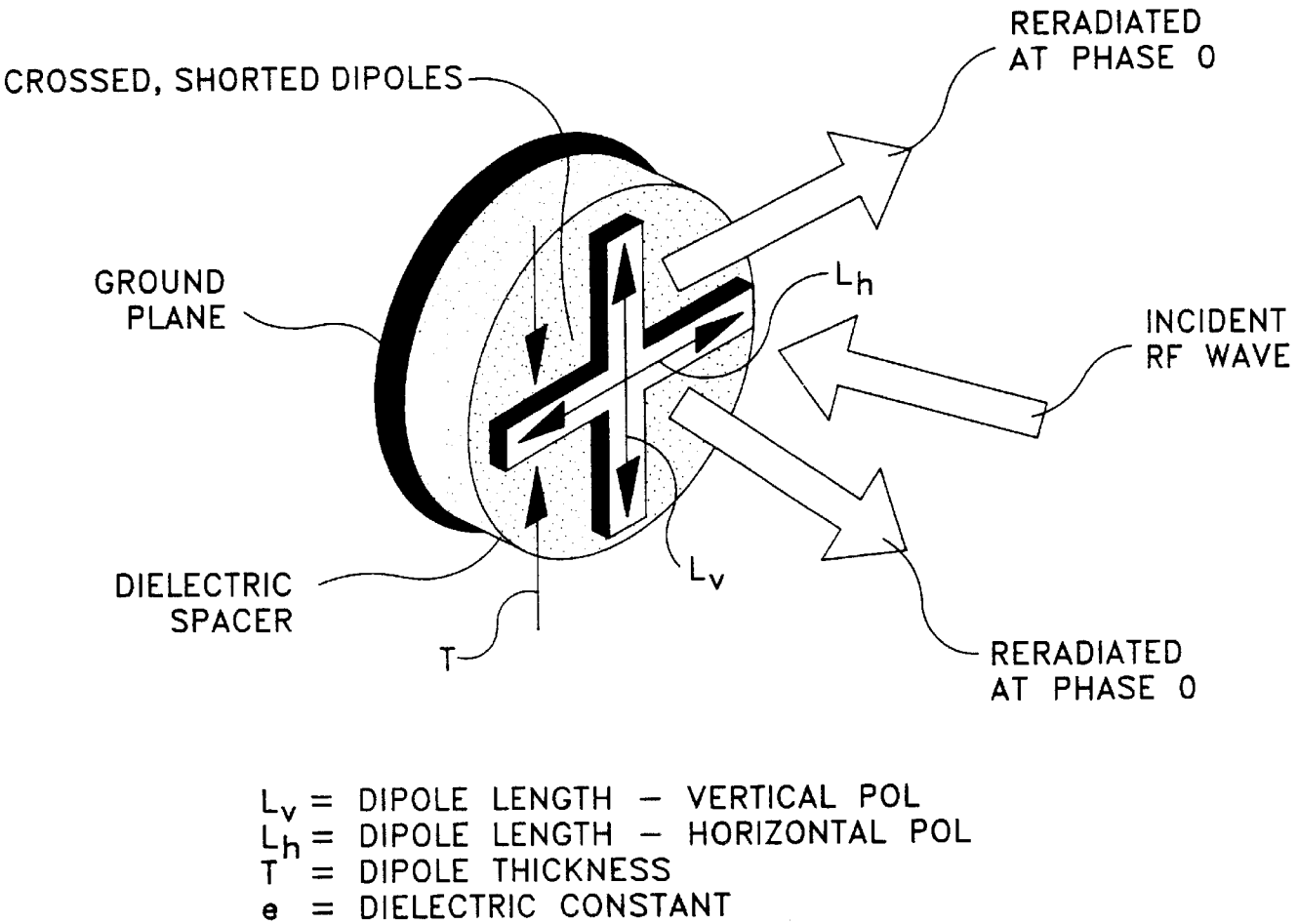
FIG–1A ELEMENTAL FLAPS™ RADIATOR
(Prior Art)

FIG–1B PHASED ARRAY CONTROL OF RF DIRECTION
(Prior Art)
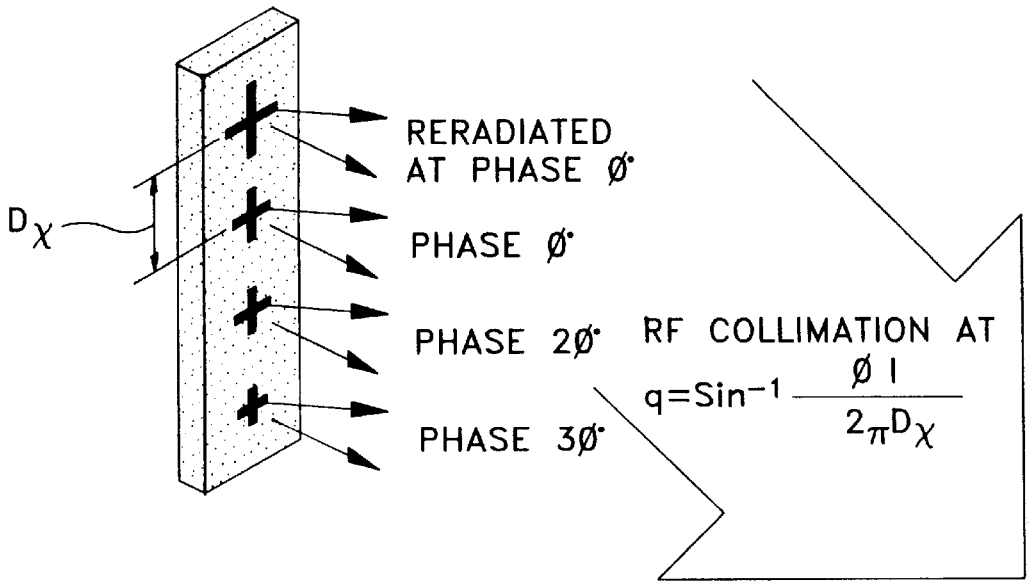

FIG-1C (Prior Art) FLAT FOCUSING, PHASED-SURFACE APPLICATION OF FLAPS™
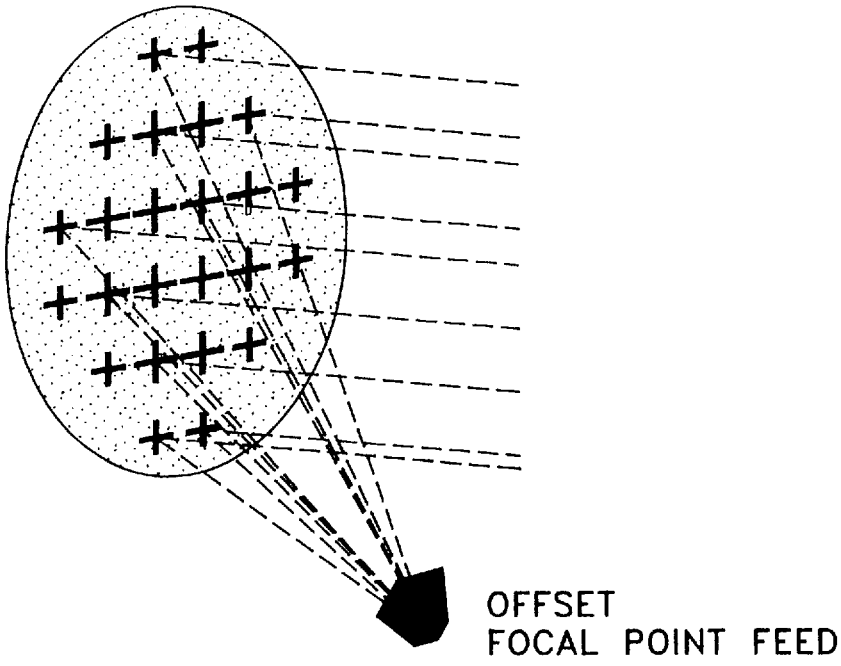

FIG-1D CONFORMAL FLAPS™ REFLECTOR
(Prior Art)
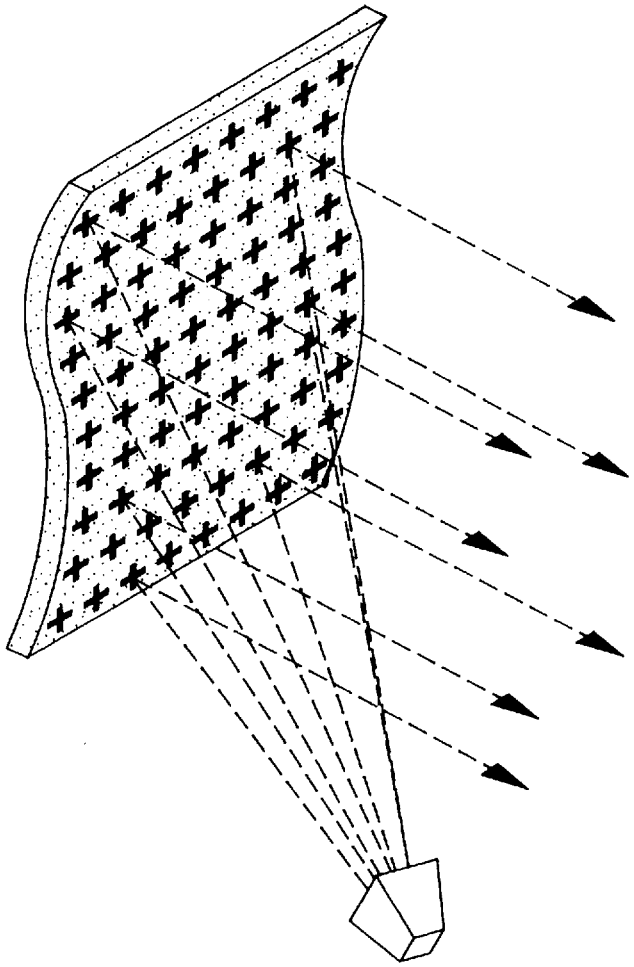

FIG-4A PIXEL APPROACH
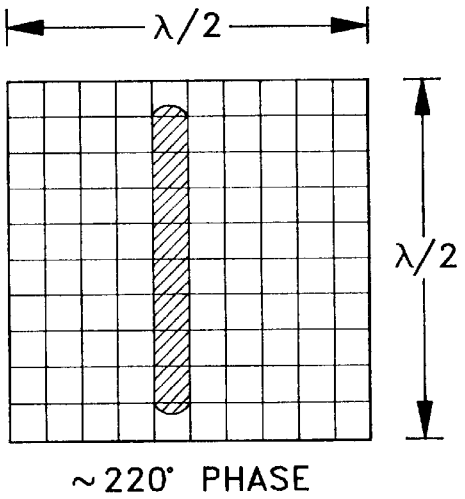
FIG-4B CHARACTER APPROACH, EACH CHARACTER IS A PHASE-SHIFTER BIT
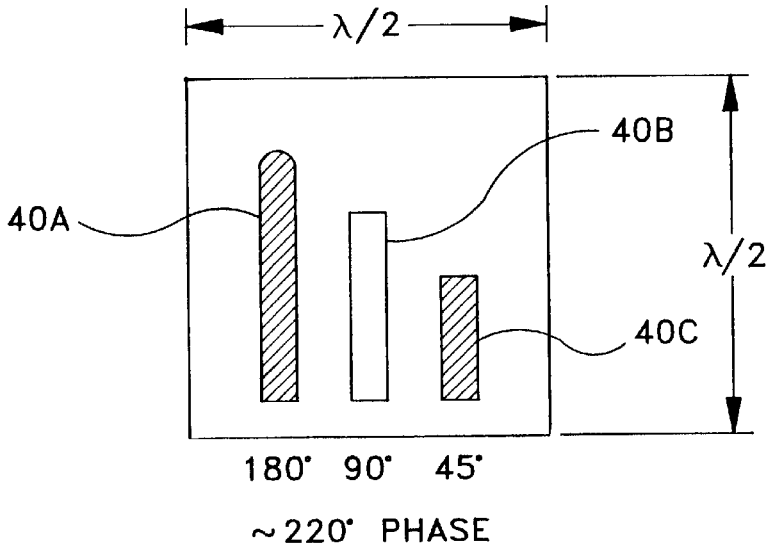
(ELEMENT BLOCKS ARE STAGGERED IN FLAPS)

DYNAMIC PLASMA DRIVEN ANTENNA

This application claims the benefit of U.S. Provisional Application No. 60/010,468 filed on Jan. 23, 1996, the disclosure of which is incorporated herein by reference.

BACKGROUND OF THE INVENTION

1. Field of the Invention

The present invention relates to phased array antennas and, more particularly, relates to dynamic plasma driven phased array antennas.

2. Description of the Prior Art

Various phased array antenna configurations have been employed in the prior art. One such antenna configuration is disclosed in U.S. Pat. No. 4,905,014 to Gonzalez et al., entitled "Microwave Phasing Structures For Electromagnetically Emulating Reflective Surfaces And Focusing Elements Of Selected Geometry," issued on Feb. 27, 1990, the disclosure of which is incorporated herein by reference.

The antenna configuration disclosed in the Gonzalez et al. patent includes an electrically thin microwave phasing structure for electromagnetically emulating a desired reflective surface of selected geometry over an operating frequency band. The microwave phasing structure includes a support matrix, i.e., a dielectric substrate, and a reflective means, i.e., a ground plane, for reflecting microwaves within the frequency operating band. The reflective means is supported by the support matrix. An arrangement of electromagnetically-loading structures is supported by the support matrix at a distance from the reflective means which can be less than a fraction of the wavelength of the highest frequency in the operating frequency range. The electromagnetically-loading structures are dimensioned, oriented, and interspaced from each other and disposed at a distance from the reflective means, as to provide the emulation of the desired reflective surface of selected geometry. Specifically, the electromagnetically-loading structures form an array of metallic patterns, each metallic pattern preferably being in the form of a cross, i.e., X configuration. It is disclosed that each electromagnetically-loading structure can be constructed to form different geometrical patterns and, in fact, could be shorted crossed dipoles, metallic plates, irises, apertures, etc. It is further disclosed that the microwave phasing structures of the Gonzalez et al. patent may be used for electromagnetically emulating a desired microwave focusing element of a selected geometry.

The selected geometry of the desired reflective surface can be a parabolic surface in order to emulate a parabolic reflector wherein all path lengths of the reflected incident electromagnetic waves are equalized by phase shifting affected by the microwave phasing structure of the present invention. While the microwave phasing structure may emulate desired reflective surfaces of selected geometries such as a parabola, the microwave phasing structure is generally flat in shape. However, the shape of the microwave phasing structure may be conformal to allow for mounting on substantially non-flat surfaces.

It is to be appreciated that the phased array antenna technology disclosed in the Gonzalez et al. patent is commonly owned by the assignee of the present invention (Malibu Research Associates, Inc. Of Calabasas, Calif.) and is generally referred to as FLAPS™ technology.

Referring now to FIGS. 1A through 1D, an exemplary embodiment of an electromagnetically-loading structure (Fig. 1A) formed in accordance with the FLAPS™ technology as disclosed in the Gonzalez et al. patent, and arrays thereof (FIGS. 1B through 1D), are shown. The basic elemental structure, as shown in FIG. 1A, is a crossed shorted dipole situated over a ground plane with an intermediate dielectric material sandwiched therebetween. It is to be appreciated that each arm of the crossed dipole independently controls its corresponding polarization. Incident RF (radio frequency) energy causes a voltage standing wave to be set up between the dipole and the ground plane. The dipole itself possesses an RF reactance which is a function of the size of the dipole. This combination of the formation of a voltage standing wave and the dipole reactance causes the incident RF energy to be reradiated with a phase shift $\phi$.

The exact value of this phase shift $\phi$ is a complex function of the dipole length and thickness, the distance between the dipole and the ground plane, the dielectric constant associated with the dielectric spacer and the angle associated with the incident RF energy. When used in an array, as shown in FIG. 1B through 1D, the phase shift $\phi$ associated with a dipole is also affected by nearby dipoles.

In practice, the dipole arm lengths may be within the approximate range of one-quarter (¼) to one-sixteenth (1/16) of the wavelength of the operating frequency of the incident RF energy in order to provide a full range of phase shifts. The preferred spacing between a dipole and the ground plane is between approximately one-sixteenth (1/16) and one-eighth (⅛) of the wavelength associated with the incident RF energy wave. It is to be appreciated that the dipole/ground plane spacing also affects certain parameters of the phased array antenna, such as form factor, bandwidth and sensitivity to fabrication errors. The dipole structure in FIG. 1A is typically formed by the etching of a printed circuit board. At longer wavelengths (i.e., lower incident RF energy operating frequencies), plating of a dielectric fiber strand is an alternate dipole fabrication method. It is to be appreciated that a radiating element formed in accordance with the FLAPS™ technology may operate at frequencies in the microwave and millimeter wave range.

As shown in FIG. 1B, each radiating element functions in a similar manner as a static phase shifter in a phased array antenna. Specifically, if a plurality of such radiating elements are designed to reradiate incident RF energy with a progressive series of phase shift $\phi$, $2\phi$, $3\phi$. . . $n\phi$, then a resultant RF beam is formed in the direction $\theta$, which may be represented as:

$$\theta = \sin^{-1}\frac{\phi\lambda}{2\pi d_x}\ \mathrm{L} \qquad \text{Eq. (1)}$$

where $d_x$ represents the spacing between radiating elements, $\lambda$ represents the wavelength of the incident RF energy and $\phi$ represents the element-to-element phase shift, i.e., the phase gradient.

Equation (1) is for beam steering in a single plane. Just as in two-dimensional phased array antennas, beam steering can be accomplished in both azimuth and elevation by application of phase gradients among the dipole radiating elements in both the x and y planes. In such case, the beam scan equation is dependent upon both the x and y spacings of the elements. It is to be appreciated that while the angle $\theta$ is referred to as the scan angle, the phased array formed by the radiating elements described in the Gonzalez et al. patent performs beam steering and focusing only, that is, the incident RF energy is reradiated in a single direction $\theta$, depending on the formation of the radiating elements, and does not perform an electronic scanning function.

While the embodiment illustrated in FIG. 1A shows a zero degree angle of incident RF energy, the incident RF wave may, in fact, be at any angle up to approximately 70 degrees. When such is the case, the angle of scattered energy, θ, may be more generally represented as:

$$\theta = \sin^{-1}\frac{\phi\lambda}{2\pi d_x} - \sin\theta_o \qquad \text{Eq. (2)}$$

where $\theta_o$ is the angle of incidence and θ is the beam energy scattering angle. Note that if:

$$\phi = \frac{4\pi d_x \sin\theta_o}{\lambda} \qquad \text{Eq. (3)}$$

then the RF energy is returned in the direction from which it came even though the surface containing the radiating elements is at a tilted angle.

The phased array described in the context of FIG. 1B is considered to perform uniform radiation beam steering. However, this concept may be extended to the situation in which either the steering angle θ or the angle of incidence $\theta_o$, or both, are adjusted over the surface of the phased array of radiating elements. Such an approach, which utilizes a flat collimating surface, is illustrated in FIG. 1C. In the approach shown in FIG. 1C, the steering angle developed by the phase shifts of each radiating element is set in order to cause all incident energy to be focused on a feed. In this manner, the phased array functions as a parabolic reflector, but in a flat surface configuration. As shown in FIG. 1C, the RF energy is both focused and steered toward an offset feed. Using the above described local steering properties further allows the surface to be conformed to any reasonably smooth shape. Such a conformal phased array is illustrated in FIG. 1D.

While the above-described phased array antennas, formed utilizing the FLAPS™ technology disclosed in the Gonzalez et al. patent, permit emulation of reflective surfaces and focusing elements of selected geometry, the individual radiating elements, e.g., dipoles, cannot be dynamically reconfigured. Due to the lack of dynamic reconfigurability of the dipoles, the above-described phased array antennas are incapable of dynamically varying the phase shifts associated with the dipoles and, therefore, such antennas cannot perform electronic scanning functions.

OBJECTS AND SUMMARY OF THE INVENTION

It is an object of the present invention to provide an antenna which includes a phased array of radiating (e.g., reflecting) elements whereby each radiating element is dynamically reconfigurable.

It is another object of the present invention to provide an antenna which includes a phased array of radiating elements, such as dipoles, whereby a length associated with each dipole is dynamically reconfigurable.

It is yet another object of the present invention to provide an antenna which includes a phased array of radiating elements, such as dipoles, whereby a spacing between each dipole is dynamically reconfigurable.

It is still a further object of the present invention to provide an antenna which includes a phased array of radiating elements whereby the dynamic reconfigurability of the radiating elements provides electronic scanning capability.

In accordance with one form of the present invention, an electronic scan antenna utilizing the FLAPS™ technology developed in accordance with U.S. Pat. No. 4,905,014 to Gonzalez et al. incorporates plasma technology whereby the radiating elements, e.g., dipoles, are dynamically configured (and reconfigured) such that the antenna may advantageously perform electronic scanning functions. The electronic scan antenna of the present invention includes at least one plasma structure. The at least one plasma structure preferably has an electrode matrix formed by the intersection of one or a plurality of parallel vertical wire electrodes and one or a plurality of parallel horizontal wire electrodes. The vertical and horizontal electrodes are preferably orthogonal to each other and are electrically isolated from each other. Each intersection of a vertical and horizontal electrode defines a pixel. Each pixel may be defined by a unique x,y coordinate. A noble gas mixture (e.g., neon and xenon) is contained within the structure and in electrical communication with the electrode matrix. The electronic scan antenna also preferably includes control circuitry for controlling the activation of each pixel. Further, the electronic scan antenna of the present invention includes reflective means, e.g., a metal ground plane, for reflecting incident RF energy waves in the operating frequency range.

In a preferred embodiment, different pixels may be excited by the control circuitry such that the plasma contained within the vicinity of the pixel becomes substantially RF conductive and, thus, advantageously behaves like a reflecting element. It is to be understood that various pixels may be simultaneously excited in order to form reflecting elements having a variety of shapes and sizes. For example, gas containing areas may be excited to form ionized plasma areas which, in turn, form reflecting elements in the shape of dipoles. Accordingly, in a manner that will be described in greater detail herein, each plasma reflecting element, in cooperation with the ground plane, reflects a portion of an incident RF wave and imparts a phase shift on the reflected wave causing the reflected wave to radiate in a direction θ.

As previously mentioned in accordance with the teachings of the FLAPS™ technology disclosed in the Gonzalez et al. patent, the adjustment of certain parameters associated with a dipole, e.g., length of dipole, affect the nature of the phase shift imparted. However, with respect to the prior art approach taught in the Gonzalez et al. patent, once a dipole is etched into a printed circuit board, the parameters of the dipole such as dipole length cannot be dynamically changed. Thus, the phase shift imparted by the particular dipole is fixed, i.e., cannot be dynamically varied.

However, in accordance with the novel utilization of the plasma structure of the present invention and the concomitant ability to selectively excite individual pixels, the parameters associated with the radiating elements formed therewith may be advantageously reconfigured in a dynamic manner. In this way, the phase shift imparted by any particular dipole may be dynamically varied by varying the length, for example, of the dipole formed by the pixels of the plasma structure. Thus, a phased array antenna capable of radiating an electronically scanned RF beam may be formed by coordinating the dynamic variation of the parameters of each dipole (e.g., length).

In general, by combining the teachings of the FLAPS™ technology and plasma technology, the present invention provides a unique phasing structure for electromagnetically emulating a desired reflective surface of selected geometry over at least one operating frequency band. Such a novel phasing structure includes reflective means (i.e., ground plane) for reflecting energy of an incident RF beam within the at least one frequency band. The phasing structure also includes a phasing arrangement of at least one plasma structure which is operatively coupled to the reflective means whereby the at least one plasma structure includes at least one gas containing area (i.e., area in the immediate vicinity of a pixel) which is reflective at the at least one operating frequency range when ionized. Such a gas containing area forms an ionized plasma area which is disposed a distance from the reflective means and has a particular size associated therewith. In this manner, the phasing structure generates a reflected RF beam with a phase shift imparted thereon, in response to the incident RF beam, so as to provide the emulation of the desired reflective surface of selected geometry. Preferably, the phasing structure further includes a control circuit for dynamically varying the size of the at least one ionized plasma area so that the phase shift imparted on the reflected RF beam dynamically varies so that the reflected RF beam is electronically scanned.

Accordingly, in merging the teachings associated with plasma technology and the FLAPS™ phased-surface technique discussed above, the present invention provides a low-cost, high-performance electronic scan antenna. Furthermore, as will be explained, the technique proposed herein is capable of operating in multiple RF bands including both microwave and millimeter wave frequency bands. Such an electronic scan antenna may have applications in space and missile radar sensors and communication systems. An agile beam electronic scan phased array antenna, as formed in accordance with the teachings of the present invention, provides performance enhancements not available in the prior art.

These and other objects, features and advantages of the present invention will become apparent from the following detailed description of illustrative embodiments thereof, which is to be read in connection with the accompanying drawings.

BRIEF DESCRIPTION OF THE DRAWINGS

FIG. 1A is a perspective view of a conventional radiating element;

FIG. 1B is a perspective view of one form of a conventional phased array antenna;

FIG. 1C is a perspective view of one form of a FLAPS™ phased array antenna;

FIG. 1D is a perspective view of a conformal form of a FLAPS™ phased array antenna;

FIGS. 4A and 4B are representations of radiating element patterns respectively illustrating the single dipole and character dipole approach of the present invention.

DETAILED DESCRIPTION OF THE PREFERRED EMBODIMENTS

Figure 2A:
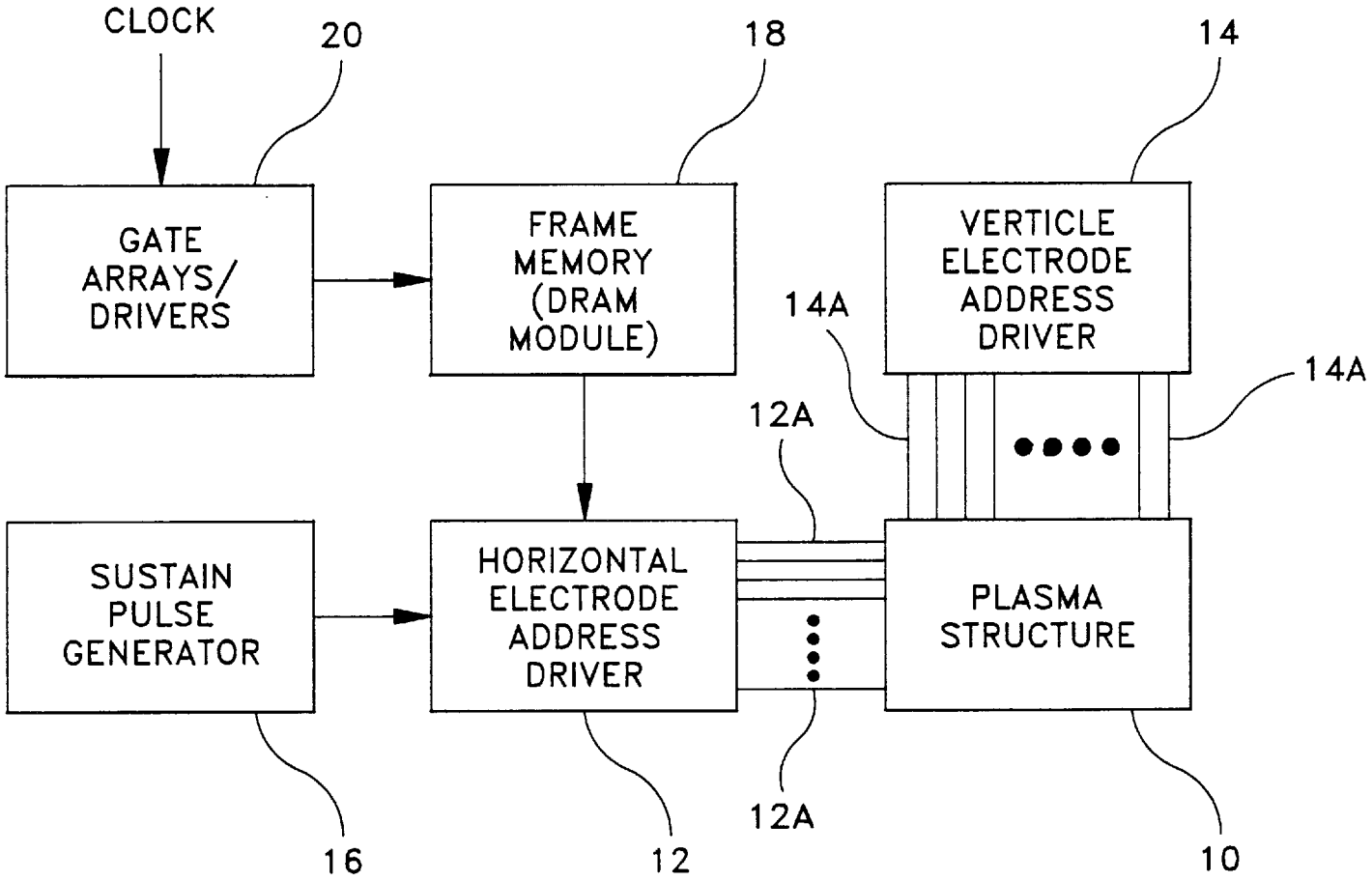
FIG. 2A is block diagram of an example of a circuit for controlling a plasma structure in accordance with the present invention.

Prior to a detailed explanation of a preferred embodiment of the dynamic plasma driven antenna of the present invention, a brief description of plasma display technology will follow. The basic plasma display includes a pair of glass plates with two sets of parallel wire electrodes and a rare gas (e.g., neon or xenon, argon and xenon, etc.) sandwiched therebetween. The two sets of parallel wire electrodes are offset 90 degrees (i.e., orthogonal) with respect to each other and are separated by a non-conductive spacer. An electrode matrix results from the intersection of the electrodes whereby each intersection forms a pixel which may be defined and, therefore, addressed by a unique x,y (horizontal, vertical) coordinate. A voltage is applied to the appropriate electrode lines of the matrix in order to create a voltage potential where the two electrodes intersect (i.e., at a pixel). This may be done by applying, for example, +150 volts to one electrode and −150 volts to the other electrode, such that a voltage potential of approximately 300 volts is present at the intersection. It is this voltage potential which causes the gas in the immediate vicinity of the intersection to fire, i.e., ionize. It is known that the mixture of noble gases (such as argon and xenon which is known as a Penning gas) is a prolific generator of electron and ions, i.e. plasma, when excited in this manner.

It is to be appreciated that in a plasma display, electron generation is an intermediate process. The electrons excite other atoms which either emit visible light, themselves, or more commonly emit ultraviolet light which in turn excites a phosphor which then emits visible light. Colors are obtained by the choice of phosphor coating. However, it is to be understood that it is the primary electron generating mechanism of plasma displays which is advantageously and uniquely exploited by the present invention.

Furthermore, one of the features of plasma displays which is important to the operation of the present invention is that the electron density generated (e.g., $N_E=10^{12}$ to $10^{14}$ electrons per $cm^3$) by the excited gases is sufficiently large to exhibit a plasma frequency which yields a highly RF conductive structure over the frequency range of approximately 1 GHz to 100 GHz. Also, another advantageous feature of the plasma element is that once fired (i.e., the gas is ionized), the element stays on (i.e., continues to conduct) even after removal of the firing voltage pulse (nonetheless, a sustaining voltage is typically uniformly applied to the activated pixel). The element is turned off (i.e., ceases to conduct) by application of a reverse voltage potential. Other methods of selectively exciting the gas may include pulsed signal excitation. It is to be appreciated that the latching property of the plasma elements, operating much like a core memory, is significant in simplifying the control circuitry employed for driving the plasma display, even for large antenna arrays, e.g., $10^8$ element array antenna, formed in accordance with the present invention.

In addition, plasma displays are known to have very fast update rates and wide operating temperature ranges, features generally attractive for antenna applications. Monochromatic displays have been made in sizes as large as 1.5 meters (diagonal) with 4 million pixels. One of the most advanced examples of a color plasma display is the Fujitsu three color helium/xenon plasma display. The plasma display has 640×480 resolution and consumes approximately 100 watts. Forty inch versions of the plasma display have been built. FIG. 2A shows the control circuitry for this type of plasma display. It is to be appreciated that while such a plasma display and associated control circuitry may be employed in the present invention to provide the novel features described herein, a monochromatic plasma display with a similar control circuit as that shown in FIG. 2A may be employed for accomplishing the same.

Thus, it is to be appreciated that plasma driven structures are suitable for providing the novel features of the present invention due to the fact that such plasma structures contain highly conductive ionized gases. Another advantage is that plasma technology, particularly for large, high-resolution plasma displays, is well developed. Also, plasma displays are very rugged (e.g., not substantially affected by environmental factors), inexpensive, thin, lightweight and typically consume approximately 100 watts of power or less. They can be computer or video driven and provide very fine resolution (e.g., 0.2 millimeters) over extremely large, independently addressable arrays. Nonetheless, it is to be appreciated that other RF conductive element display techniques which exhibit a suitable electron density upon excitation may be used to achieve the novel features associated with the present invention.

Figure 2B:
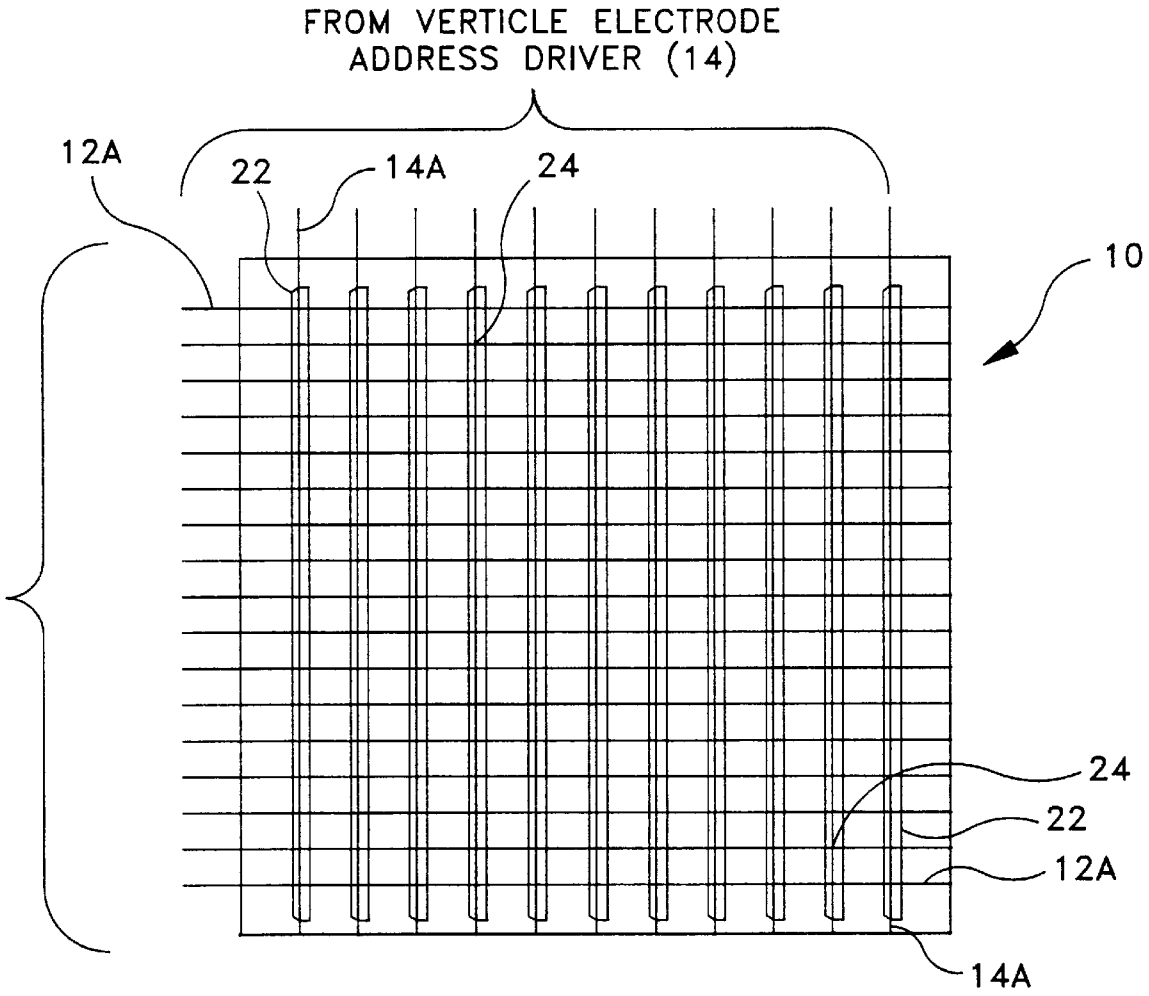
FIG. 2B is cross sectional view of an example of a plasma structure of the present invention.

Referring now to FIGS. 2A and 2B, a block diagram of an exemplary control circuit for driving a plasma structure (FIG. 2A) and a cross sectional representation of a plasma structure (FIG. 2B) are shown. It is to be appreciated that the control circuit illustrated in FIG. 2A is presented for exemplary purposes and, therefore, other forms of control circuits may be utilized for driving the plasma structure formed in accordance with the present invention.

A plasma structure 10 is respectively operatively coupled to a horizontal electrode address driver 12 and a vertical electrode address driver 14. Specifically, the horizontal electrode address driver 12 is operatively coupled to the plurality of horizontal electrodes 12A which run, in parallel, through the plasma structure 10, while the vertical electrode address driver 14 is operatively coupled to the plurality of vertical electrodes 14A which also run, in parallel, through the plasma structure 10. The horizontal and vertical electrodes are orthogonal (90 degrees offset from one another) and electrically isolated with respect to one another, and form the electrode matrix (or grid) previously discussed. The horizontal electrode address driver 12 is operatively coupled to a frame memory (DRAM module) 18 which may be controlled via a computer (not shown) through gate/array drivers 20. The vertical electrode address driver 14 may also be controlled through the computer (not shown). Typically, when the pixels (intersections of the horizontal and vertical electrodes) of the plasma structure 10 are to be addressed and thus activated (i.e., create voltage potential between intersecting electrodes), the vertical electrodes are selectively energized (i.e., voltage applied thereto) and the particular horizontal electrodes are selectively energized based on data stored in the frame memory 18. In this manner, the particular pixels of interest are activated, that is, the gas in the vicinity of the pixel is ionized. As previously mentioned, although plasma structure 10 has a latching feature, a pulse generator 16 may be provided to sustain the activation of the pixels, that is, provide a voltage potential (typically less than the initial excitation voltage potential) so that the gas associated with the pixel remains ionized and, thus, RF conductive.

FIG. 2B illustrates an example of a plasma structure suitable for providing the novel features of the present invention described herein. As previously mentioned, the structure is formed by a pair of glass plates with the two sets of electrodes, 12A and 14A, and a noble gas (e.g., neon or xenon, argon and xenon, etc.) sandwiched therebetween. The rare gas may be contained in parallel vertical tubes 22 which are preferably etched on the inside surface of the glass plates. The tubes 22 may run in a horizontal direction, in the alternative. Furthermore, it is to be appreciated that the use of the spatial references, vertical and horizontal, is for the sake of simplicity. It is to be understood that while the orientation of the electrodes and gas tubes with respect to each other is important, the spatial reference is not critical to the invention. In fact, the horizontal electrodes may be generally referred to as cathodes, while the vertical electrodes may be generally referred to as anodes, or vice versa. Also, the number of electrodes shown in FIG. 2B is by way of example only, that is, plasma structures with more or less horizontal electrodes or more or less vertical electrodes (and vertical tubes) may be employed.

Activation of a particular pixel, and ionization of the gas associated therewith, will now be explained. A pixel 24 is defined as the intersection of a horizontal electrode (cathode) 12A and a vertical electrode (anode) 14A. As shown in FIG. 2B, the vertical electrodes 14A bisect the gas tubes 22 such that the intersection of each vertical electrode 14A and each horizontal electrode 12A, i.e., a pixel 24, occurs substantially near and/or within the confines of the gas tube 22. In this manner, when a first voltage is applied to a particular horizontal electrode 14A and a second voltage (sufficiently different from the first voltage) is applied to a particular vertical electrode 12A, the resulting voltage potential (difference between the first and second voltages) occurring at the intersection, or pixel 24, causes the gas contained in the immediate vicinity of the intersection to fire or ionize. It is to be understood that while the gas within any particular gas tube 22 is continuous, localized ionization is achieved by activating only the desired pixels which thereby causes only the gas in the immediate vicinity of those pixels to ionize.

Thus, by utilizing the pixel activation approach described above, a plasma structure 10 may be preferably fabricated including a pair of glass plates whereby a first glass plate has one set of electrodes printed, plated or deposited thereon and chemically etched grooves (serving as the gas tubes 22) formed therein. Similarly, the other glass plate has the second set of electrodes printed, plated or deposited thereon. A non-conductive spacing layer is placed between the sets of electrodes, before sandwiching the glass plates together, so that the electrode sets remain electrically isolated. The structure is sealed, evacuated and filled with a noble gas mixture (e.g., neon and argon) such that the gas mixture is contained within the gas tubes etched in one of the glass plates.

Referring now to FIGS. 3A through 3D, a preferred embodiment of a dynamic plasma driven antenna of the present invention in the form of an electronic scan antenna 30 is shown. Particularly a composite plasma structure 32 (FIG. 3A) is mounted on a ground plane 34. An RF feed 36 is positioned in front of the composite plasma structure 32 and, as will be explained, provides the incident RF energy at a particular operating frequency which will be uniquely converted to an electronically scanned beam by electronic scan antenna 30.

Figure 3A:
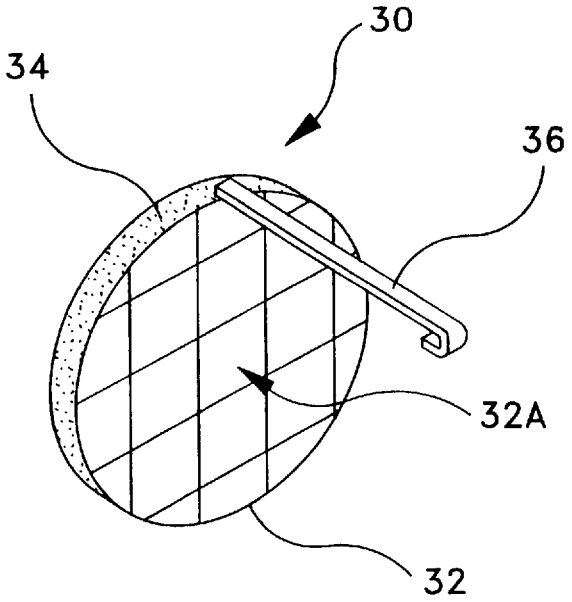
FIG. 3A is a perspective view of a dynamic plasma driven antenna of the present invention.
Figure 3B:
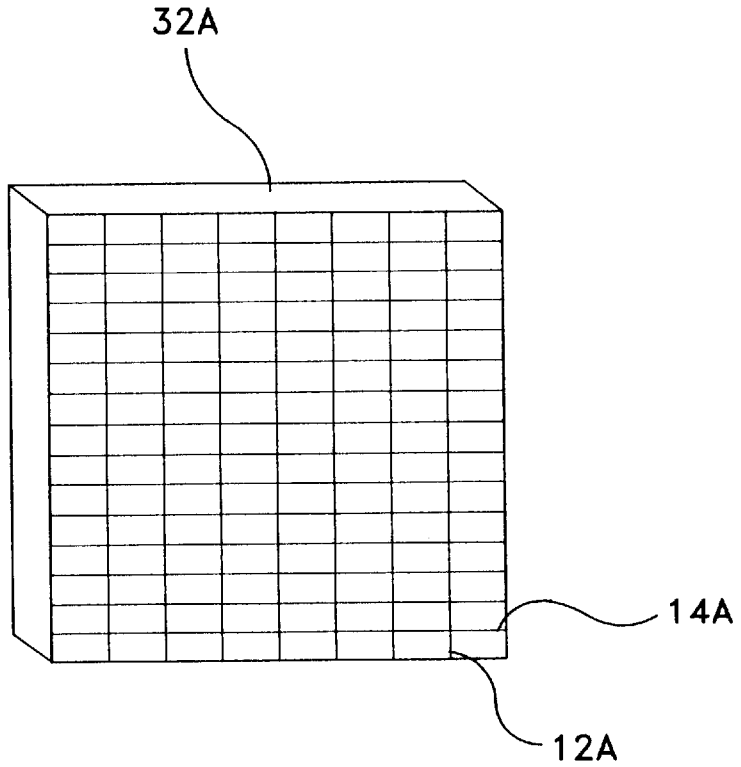
FIG. 3B is a perspective view of a plasma structure of the present invention.

The composite plasma structure 32 is preferably formed from a plurality of individual plasma structures 32A (FIG. 3B). It is to be appreciated that each plasma structure 32A may be formed in a similar manner to the plasma structure 10 shown in and described in the context of FIG. 2B, including similar horizontal electrodes 12A, vertical electrodes 14A and gas tubes 22. The plasma structure 32 may be driven by one composite control circuit or a plurality of individual control circuits which control each individual plasma structure 32A. In either case, a control circuit such as the circuit shown in FIG. 2A, with appropriately sized electrode drivers, may be employed.

Figure 3C:
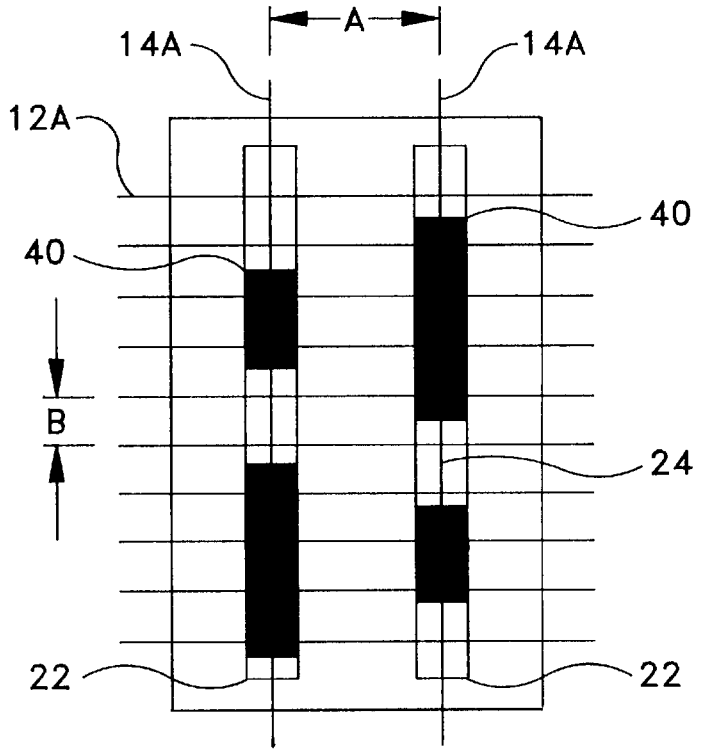
FIG. 3C is a cross sectional, enlarged view of a portion of a plasma structure of the present invention and exemplary radiating elements formed therewith.

In general, contiguous pixels (such as pixels 24 shown in FIG. 2B) are excited in the manner previously described to form varying sized radiating (e.g., reflecting) elements 40 (FIG. 3C) which, as will be explained, are substantially RF conductive and, thus, advantageously act similar to the electromagnetically-loading structures discussed in the context of the FLAPS™ technology and Gonzalez et al. patent. While the radiating elements 40 may take on various sizes (i.e., lengths) by selectively addressing and activating various pixels 24 of the plasma structure 32A, the preferred shape of the radiating element 40 is that of a dipole, as shown in FIG. 3C. Accordingly, in a manner that will be described in greater detail herein, each plasma radiating element 40, in cooperation with the ground plane 34, reflects a portion of an incident RF wave directed thereon from the RF feed 36 and imparts a phase shift on the reflected wave portion. Each radiating element 40 is formed to reflect the portion of the incident RF wave directed thereon with a phase shift such that a composite reflected wave is formed to radiate in a direction θ.

As is known, the adjustment of certain parameters associated with a dipole, e.g., length of dipole, affects the nature of the phase shift imparted. Since the length of the dipoles 40 can be dynamically varied, i.e., by activating a greater or lesser number of contiguous pixels 24 of the plasma structure 32A, the phase shift imparted by each dipole 40 can be dynamically varied. Thus, a composite reflected beam, formed by combining each portion of the incident RF wave reflected by each dipole 40, may be generated such that the composite beam is able to electronically scan (i.e., radiate or sweep over a selected angular and/or elevational range) as the phase shifts of the radiating elements 40 are dynamically varied. In this manner, the plasma structure 32 (in cooperation with the ground plane 34), which is planar in shape, may electromagnetically emulate any desired reflective surface of selected geometry (e.g., paroblic reflector) over the operating frequency band.

An explanation of how the ionized plasma formed by activating a particular pixel 24 of the plasma structure 32A provides the RF properties necessary to perform the functions of the present invention will now be provided. An ionized gas is basically a cloud of electrons and ions. Both electrons and ions interact with RF fields but because of their mass, the ions are essentially stationary and only the effect of the electrons is significant. The interacting aspect of the electrons provides that through a combination of the electrons charge and mass and via Maxwell's equations, the electrons exhibit a physical/electrical resonance phenomena. Specifically, an electron in motion generates an orthogonal magnetic field. A rate change of this magnetic field produces an electric field back in the direction of motion of the electron and out-of-phase therewith. This field acts as a "spring" against the electron mass and is proportional to the square of the charge and, thus, produces a resonant system. A damping factor in the resonant system is caused by electron collisions. Accordingly, a plasma resonant frequency may be represented as:

$$f_p=(Ne^2/\pi m)^{1/2} \qquad \text{Eq. (4)}$$

where;

N=electron density $$\frac{e}{m}=\frac{\text{electron charge}}{\text{mass}}=1.76\times10^{11}\ \text{coulombs/kg}$$

$$m=\text{electron mass}=9.11\times10^{-31}kg$$

The number of electrons per unit area affects both the total charge and the electron mass of the resonant system. Therefore, the bulk resonant frequency depends on the number of electrons per unit area and, thus, provides means for controlling the plasma frequency. If RF energy excites the plasma at a frequency below the electron cloud plasma frequency (i.e., resonant frequency) then the electrons follow the RF field and, thus, the electron cloud advantageously acts like a conductor, in nearly the same sense as a metal. The electron cloud created by the ionization of the gas causes the ionized area to exhibit a reactance (in a similar manner as described in the Gonzalez et al. patent) which produces a proportional phase shift imparted on the reflected RF energy. If RF energy excites the plasma at a frequency above the resonant frequency, the electrons oscillate out-of-phase with the RF energy and the plasma acts like a transparent, lossless medium, but with a phase shift advantageously imparted thereon. Thus, a plasma driven antenna formed in accordance with the present invention may operate at any microwave or millimeter wave frequency band by adjusting such operating frequency to be above or below the resonant frequency associated with the plasma structure. Such a feature permits the present invention to be utilized in substantially any radar and/or communications application.

While the fundamentals of plasma ionization/RF conductivity are substantially based on the analysis of an electron cloud as a resonant system, dependent upon the electron mass and charge and Maxwell's equations (taking into account atom collision loss factors), it is to be appreciated that one of the critical facts is that the typical plasma used in displays and for lighting have sufficient electron densities to support high conductivity in the 1 GHz to 100 GHz frequency range. Such a broad ranging frequency response, in part, provides the impetus for utilizing plasma structures in the phased array antennas of the present invention.

Referring again to FIG. 3C, in view of the above explanation of the plasma ionization/RF conductivity principle taught in accordance with the present invention, it can be seen that the length of each radiating element or dipole 40 can be dynamically varied by activating or deactivating certain pixels 24 along the axes formed via electrodes 14A as they bisect gas tubes 22. The pixels are preferably activated or deactivated via control of a computer (not shown) through a plasma structure control circuit such as the one illustrated in FIG. 2A. Such an increase or decrease in dipole length corresponds to greater or lesser areas of plasma being present within a particular radiating element. In turn, such variation in plasma content proportionately affects the electron density associated with each radiating element and, subsequently, the phase shift imparted by each radiating element.

In this manner, the phase shift imparted by each dipole 40, in cooperation with the ground plane 34, may be dynamically varied. It is to be appreciated that, in a preferred embodiment, the ground plane 34 is positioned at a distance of approximately 0.15 inches from the dipoles 40. With such an appropriately chosen spatial separation between the ground plane 34 and each dipole 40, a voltage standing wave may be formed therebetween (in a similar manner as disclosed above with respect to the FLAPS™ technology) so that each dipole 40 effectively radiates a portion of the composite RF beam generated by the electronic scan antenna 30 of the present invention.

It is to be understood that because the preferred form of a radiating element 40 is a single dipole, the portion of the composite RF beam radiated by each dipole 40 is polarized in one plane (i.e., single polarization). As illustrated in FIG. 3C, since each dipole 40 is oriented along the axis formed by electrode 14A, then the portion of the composite RF beam radiated therefrom is polarized in that same direction.

Thus, a concern arises with respect to the density (i.e., number per unit width) and thickness (i.e., width) of the vertical electrodes 14A in that, if the density and/or thickness of electrodes 14A is too great, the electrodes 14A will disadvantageously act similar to a ground plane, thereby preventing the incident RF energy from reaching the plasma and providing the inventive features discussed herein. However, in accordance with the present invention, several methods of fabricating the plasma structure to advantageously prevent such a situation from occurring will now be described.

The first preferred method involves forming a "thinned" vertical electrode set. In other words, while standard plasma displays require dense electrode grids (including vertical and horizontal electrodes) in order to provide high pixel resolution (such as at least 30 electrodes per inch), the plasma structure of the present invention uniquely provides a thinner electrode grid, particularly in the vertical plane. Preferably, to ensure that RF energy passes therethrough, the vertical electrodes 14A are uniformly separated by a distance A (FIG. 3C) preferably equivalent to approximately one half (½) of the wavelength of the operating frequency of the antenna. In a preferred embodiment, this separation is equivalent to approximately 0.2 inches. In addition, the thickness of each vertical electrode (and horizontal electrode) is preferably very thin (i.e., as small as 0.001 inches to 0.0002 inches or approximately six one-thousandths (0.006) of the wavelength of the preferred operating frequency). Further, the thin electrodes (which are generally inductive in nature) can further be matched-out (made RF transparent) by applying a dielectric (capacitive) coating thereto.

Another method for preventing the vertical electrodes of the plasma structure from acting similar to a ground plane involves selecting a substantially RF transparent material to form the electrodes, e.g., a material other than metal. For instance, sputterable or plateable materials that are low frequency conductive so that they can carry low current (to create voltage potential at pixel), but which are substantially RF transparent, may be employed. By way of example, the composition of indium tin oxide may be employed to provide such advantageous properties.

It is to be understood that the horizontal electrodes are cross-polarized with respect to the reflected RF energy and, therefore, substantially RF transparent with respect thereto. Thus, a densely spaced set of horizontal electrodes is preferred in order to provide high resolution for controlling the length of the dipoles 40 (FIG. 3C). A preferred uniform separation between horizontal electrodes, denoted in FIG. 3C as distance B, is approximately 0.030 inches.

The preferred electrode spacings may be derived from the following electric field reflection equations for parallel and perpendicular electrode sets. Particularly, parallel and perpendicular reflection may be respectively represented as:

$$r_{par} = \left[ 1 + \left( \frac{2d}{\lambda} \ln \frac{d}{2\pi a} \right)^2 \right]^{-1} \quad \text{Eq. (5)}$$

$$r_{perp} = \left( \frac{2\pi^2 a^2}{\lambda d} \right)^2 / 1 + \left( \frac{2\pi^2 a^2}{\lambda d} \right)^2 \quad \text{Eq. (6)}$$

where d represents electrode spacing, λ represents the wavelength of the operating frequency and a represents wire radius. Since the RF energy is polarized with respect to the vertical axis (due to the orientation of the dipoles 40), the parallel reflection (Eq. (5)) for an operating frequency associated with the incident RF energy of 35 GHz with a vertical electrode spacing of 0.2 inches and an electrode radius of 0.0005 inches is approximately 0.04. Such a reflection is substantially small enough to be tolerable for purposes of permitting RF energy to pass therethrough. Likewise, the reflection (Eq. (6)) with respect to the horizontal electrodes (perpendicular) for a 35 GHz operating frequency, a nominal horizontal electrode spacing of 0.03 inches, an electrode radius of 0.0005 inches and a dipole length resolution of λ/12 is approximately less than 0.001. Such component loss is negligible. It is to be understood that the horizontal electrodes may also be cross polarized via an external polarizer to minimize RF reflection.

Other design modifications that may preferably be included in fabricating a plasma structure in accordance with the present invention may include the use of a higher quality fused quartz glass (as compared to soda-lime glass typically used in standard plasma displays) to form the glass plates which sandwich the electrode matrix and rare gas. Also, the glass plates of the plasma structure are preferably thinner than standard plasma displays, i.e., glass plates of approximately 2 millimeter to 4 millimeter in thickness may preferably be employed. Furthermore, a different rare gas mixture may be employed to increase blooming and dipole uniformity.

Figure 3D:
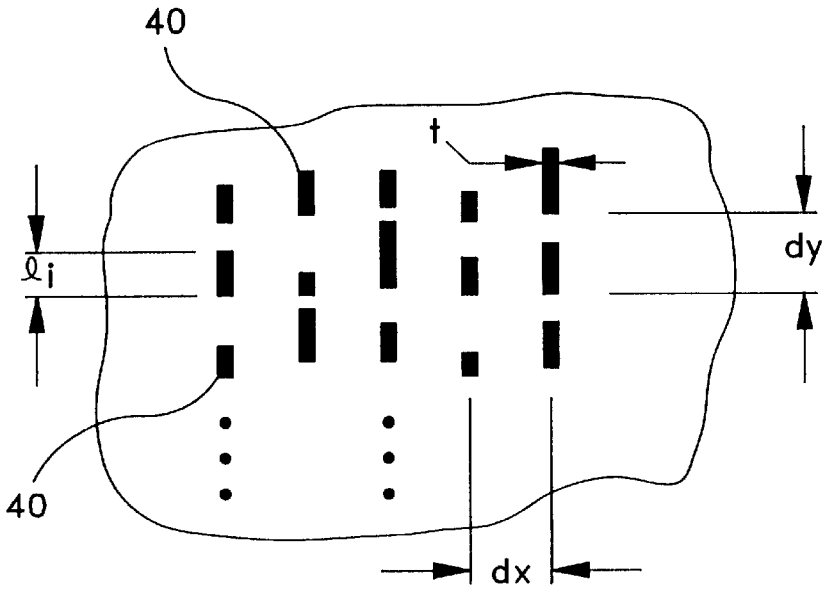
FIG. 3D is a partial exemplary representation of a radiating element pattern formed in accordance with the present invention.

Referring now to FIG. 3D, an exemplary pattern of radiating elements 40 (dipoles) generated by a plasma structure, formed in accordance with the present invention, is shown. Such a dipole pattern may be "displayed", for example, in response to a command computer operating as part of a radar system which issues a command for the generation of a particular electronic beam position. The computer determines the required phase shifts to be generated by the dipoles 40, based on the current operating frequency, in order to generate the electronic beam desired. In order to provide the required phase shifts, the lengths of the plasma formed dipoles 40 are dynamically adjusted in the manner described herein.

As shown in FIG. 3D, the horizontal spacing $d_x$ between dipoles (which corresponds to the vertical electrode separation) is, preferably equivalent to approximately one half the wavelength of the operating frequency (λ/2), as previously explained, to permit for polarization of the reflected RF energy in the vertical direction. In other words, it may be stated that the minimum separation between vertically adjacent dipoles of λ/2 is preferred in order to provide proper RF decoupling between the dipoles. In a similar manner, the vertical spacing $d_y$ between the start of one dipole and the start of the next dipole is also preferably about λ/2 in order to provide RF decoupling therebetween. At a preferred operating frequency for the electronic scan antenna of the present invention, both $d_x$ and $d_y$ are approximately 0.2 inches.

Furthermore, as shown in FIG. 3D, the minimum length $l_i$ of a dipole is approximately 0.030 inches, which corresponds to the preferred separation between horizontal electrodes. However, as previously explained, the length of a dipole is dynamically variable and, thus, can be increased to a desired maximum length (e.g. 0.170 inches) depending on the operating frequency and antenna application. In addition, the width t of a dipole is dependent on the width of the gas tubes 22 etched in the glass plate of the plasma structure. Such width may nominally be approximately 0.02 inches.

It is to be appreciated that, in accordance with the present invention, the dipole pattern displayed by the plasma structure may be dynamically changed such that a completely different dipole pattern with dipoles of different sizes (i.e., lengths) and spacings may be generated and displayed. In this manner, dipole patterns may be formed which permit antennas formed in accordance with the present invention to operate at different operating frequencies and to generate different reflected beams of different shapes which radiate (or scan) in different directions.

In an alternative embodiment of the present invention, an electronic scan antenna with multi-band capability (e.g., able to operate in two frequency bands such as the X and $K_a$ frequency band) may be formed. The multi-band antenna may preferably be similar in construction and operation to the electronic scan antenna 30 shown in FIG. 3A; however, a resonant grid (not shown) is added to the configuration which serves as a ground plane for the RF energy exhibiting the second operating frequency. Such an electronic scan antenna may preferably operate at any two bands within approximately a 3:1 frequency ratio, e.g., L-band/C-band, S-band/X-band, etc. The RF feed 36 may preferably provide the incident RF energy at both frequencies; however, separate feeds may be employed in which case it is not necessary for each feed to have the same focus since the antenna of the present invention phase compensates depending on the operating frequency of the incident wave and the plasma frequency, as previously explained.

For an X-band/$K_a$-band embodiment, the ground plane 34 is preferably positioned approximately 0.160 inches from the dipoles 40 to provide the X-band ground plane, while the resonant grid is positioned therebetween at approximately 0.04 inches from the dipoles 40 to provide the $K_a$-band ground plane.

Referring now to FIGS. 4A and 4B, a further alternative embodiment of the plasma driven antenna of the present invention is shown. FIG. 4A shows the single, variable length dipole approach for generating phase shifts previously illustrated (FIGS. 3C and 3D) and explained. However, in an alternative approach, sets of dipoles (e.g., two, three or more) may be formed in a similar manner as a single dipole, but the dipole set, as a whole, provides a composite phase shift. As shown in FIG. 4B, three dipoles 40A, 40B and 40C are formed having respective phase shifts 180 degrees, 90 degrees and 45 degrees associated therewith (dependent on their length and the positioning of the ground plane, as discussed herein). The respective lengths of the dipoles 40A, 40B and 40C are approximately equivalent to 0.48 λ, 0.46 λ and 0.40 λ (i.e., percentage of the wavelength of the operating frequency). All three dipoles are preferably formed using a plasma structure having a vertical electrode separation which permits at least three dipoles to be formed within a width of λ/2. While it has previously been explained that vertical electrode spacing of less than λ/2 may provide RF conduction loss, it is to be appreciated that because the three dipoles are treated as providing a composite phase shift, the closer spacing is not a substantial concern. However, it is to be understood that the vertical electrodes may be formed with substantially RF transparent material (indium tin oxide composition) to further minimize RF conductivity loss. Thus, by exciting two or more dipoles, a composite dipole ("character") is formed which provides a composite phase shift capable of ranging from 0 degrees through 360 degrees.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. An electronic scan antenna for generating an electronically scanned RF beam in response to an incident RF beam having at least one operating frequency band associated therewith, which comprises:

reflective means for reflecting the incident RF beam;

a phasing arrangement of plasma structures being operatively coupled to the reflective means, each plasma structure including a plurality of gas containing areas which are reflective at the at least one operating frequency range, when ionized, forming ionized plasma areas, each ionized plasma area being disposed a first distance from the reflective means and a second distance from adjacent ionized plasma areas and each ionized plasma area having a size associated therewith such that each ionized plasma area, in cooperation with the reflective means, provides a portion of a composite RF beam having a phase shift associated therewith; and a control circuit for selectively ionizing the gas containing areas such that the size of each ionized plasma area may be dynamically varied so as to dynamically vary the phase shift imparted on each portion of the composite RF beam thereby permitting the composite RF beam to be electronically scanned.

2. An electronic scan antenna as defined in claim 1 wherein each plasma structure further includes an electrode grid formed by respective orthogonal intersection of a plurality of cathodes and a plurality of anodes operatively coupled to the control circuit such that each intersection occurs at one of the gas containing areas and further wherein the control circuit selectively activates the intersections in order to ionize the gas within the gas containing areas.

3. An electronic scan antenna as defined in claim 1 wherein each ionized plasma area is disposed, with respect to adjacent ionized plasma areas, a distance equivalent to approximately one half of a wavelength associated with the at least one operating frequency band.

4. An electronic scan antenna as defined in claim 1 further including a second reflective means disposed a distance from the ionized plasma areas for reflecting energy of an incident RF beam within a second operating frequency band.

5. An electronic scan antenna as defined in claim 1 wherein the at least one ionized plasma area forms a radiating element in the form of a dipole.

6. An electronic scan antenna as defined in claim 5 wherein the control circuit dynamically varies a length of the dipole in order to dynamically vary the phase shift imparted on the reflected RF beam.

7. An electronic scan antenna as defined in claim 1 wherein each plasma structure has a planar geometry.

8. An electronic scan antenna as defined in claim 1 wherein the desired reflective surface is a parabolic reflector.

9. An electronic scan antenna as defined in claim 1 wherein the reflective means includes a ground plane structure.

10. An electronic scan antenna as defined in claim 1 wherein at least first and second ionized plasma areas provide a composite phase shift from the combination of the phase shifts respectively provided by each of the individual ionized plasma areas whereby the composite shift may be dynamically varied by dynamically varying the size of at least one of the first and second ionized plasma areas.

11. A radio frequency (RF) phasing structure for electromagnetically emulating a desired reflective surface of selected geometry over at least one operating frequency band, which comprises:

reflective means for reflecting energy of an incident RF beam within the at least one frequency band;

a phasing arrangement of at least one plasma structure being operatively coupled to the reflective means, the at least one plasma structure including at least one gas containing area which is reflective at the at least one operating frequency range, when ionized, forming at least one ionized plasma area, the ionized plasma area being disposed a distance from the reflective means and having a size associated therewith whereby the phasing structure generates a reflected RF beam with a phase shift imparted thereon in response to the incident RF beam so as to provide the emulation of the desired reflective surface of selected geometry; and a control circuit for dynamically varying the size of the at least one ionized plasma area such that the phase shift imparted on the reflected RF beam dynamically varies so that the reflected RF beam is electronically scanned.

12. A phasing structure as defined in claim 11 wherein the phasing arrangement further includes a plurality of ionized plasma areas, each ionized plasma area being disposed a first distance from the reflective means and having a size associated therewith, each ionized plasma area further being disposed a second distance from each adjacent ionized plasma area, whereby each ionized plasma area, in cooperation with the reflective means, generates a portion of the reflected RF beam having a phase shift imparted thereon in response to the incident RF beam so as to generate a composite RF beam having a scan angle associated therewith.

13. A phasing structure as defined in claim 13 wherein each ionized plasma area is disposed, with respect to adjacent ionized plasma areas, a distance equivalent to approximately one half of a wavelength associated with the at least one operating frequency band.

14. A phasing structure as defined in claim 11 further including a second reflective means disposed a distance from the ionized plasma areas for reflecting energy of an incident RF beam within a second operating frequency band.

15. A phasing structure as defined in claim 11 wherein the phasing arrangement further includes a second ionized plasma area being disposed a first distance from the reflective means and second distance from the at least one ionized plasma area and having a size associated therewith whereby the at least one ionized plasma area and second ionized plasma area impart a composite phase shift on the reflected RF beam formed from a combination of the individual phase shifts provided by each plasma area.

16. A phasing structure as defined in claim 11 wherein the at least one ionized plasma area forms a radiating element in the form of a dipole.

17. A phasing structure as defined in claim 16 wherein the control circuit dynamically varies a length of the dipole in order to dynamically vary the phase shift imparted on the reflected RF beam.

18. A phasing structure as defined in claim 11 wherein the at least one plasma structure has a planar geometry.

19. A phasing structure as defined in claim 11 wherein the desired reflective surface is a parabolic reflector.

20. A phasing structure as defined in claim 11 wherein the reflective means includes a ground plane structure.

* * * * *